United States Patent [19]

Zippel

[11] 4,191,484

[45] Mar. 4, 1980

[54] DOCUMENT FILES

[75] Inventor: Herbert Zippel, Altdorf, Fed. Rep. of Germany

[73] Assignee: Herbert Zippel GmbH & Co., KG, Nuremberg, Fed. Rep. of Germany

[21] Appl. No.: 656,325

[22] Filed: Feb. 9, 1976

[30] Foreign Application Priority Data

Feb. 17, 1975 [DE] Fed. Rep. of Germany ..... 2506637

[51] Int. Cl.[2] ..... B42F 13/06; B42F 13/08

[52] U.S. Cl. ..... 402/15; 24/16 PB

[58] Field of Search ..... 402/13, 14, 15, 16, 402/17, 18, 47; 24/16 PB

[56] References Cited

U.S. PATENT DOCUMENTS

| | | | |
|---|---|---|---|
| D. 208,729 | 9/1967 | Geisinger | 24/16 PB X |
| 1,690,230 | 11/1928 | Kline | 402/15 |
| 2,432,409 | 12/1947 | Gooley | 402/15 |
| 2,434,083 | 1/1948 | Snyder | 402/16 |
| 3,073,315 | 1/1963 | Schade | 402/15 |

FOREIGN PATENT DOCUMENTS

| | | | |
|---|---|---|---|
| 180455 | 1/1907 | Fed. Rep. of Germany | 402/17 |
| 1191115 | 4/1959 | France | 402/15 |
| 862775 | 3/1961 | United Kingdom | 402/17 |
| 917356 | 2/1963 | United Kingdom | 402/15 |

*Primary Examiner*—Jerome Schnall
*Attorney, Agent, or Firm*—James E. Nilles

[57] ABSTRACT

A document file is disclosed having a quick release clamping mechanism. The mechanism includes a tube of resilient and flexible plastic having a central portion anchored in the file and two end portions onto which documents with punched holes can be threaded. The mechanism includes a clamping plate also to be threaded onto the two end portions and having clamping tongues under which the free end portions of the tube can be wedged after passing through holes in the clamping plate. Each clamping tongue has a cam surface to improve the wedging action it imparts to the end portions of the tube.

1 Claim, 3 Drawing Figures

DOCUMENT FILES

BACKGROUND OF THE INVENTION

1. Field of the Invention

The present invention relates to quick release document files for documents with punched holes for example.

2. Description of the Prior Art

In the document file disclosed in German Patent Specification No. 1,073,445 the central portion of a plastics tube is anchored on the bottom of the file, and the two free end portions of the tube are threaded through corresponding holes in a clamping plate and wedged under corresponding clamping tongues of the plate.

This file has the disadvantage that the two free end portions of the tube, while ideally extending vertically upwardly (when allowed freedom to move), do in fact diverge apart under the natural resilience of the tube which tends to revert to its original rectilinear form. As a result, when the free end portions of the tube are wedged under the clamping tongues, they are biased in a sense to dislodge themselves from the tongues and so loosen the documents in the file.

It is an object of the invention to provide an improved document file.

It is a more specific object of the invention to provide a clamping mechanism for a file in which the free end portions of the tube are more effectively held by the clamping tongues.

SUMMARY OF THE INVENTION

According to the invention there is provided a quick release clamping mechanism for a document file, comprising a flexible and resilient hollow tube having a central portion arranged to be anchored to the file, and an elongate clamping plate having two holes spaced longitudinally of the plate by a distance corresponding to that between holes punched in documents to be held by the file, the clamping plate also having two clamping tongues extending longitudinally of the plate away from opposite longitudinal ends of a central portion of the plate, each tongue being aligned transversely of the plate with a corresponding hole in the plate and having a cam surface whereby when a corresponding end portion of the tube is threaded through punched hole documents, through a respective one of the two holes in the clamping plate, flexed to extend transversely over the upper surface of the clamping plate and shifted longitudinally of the plate to lie under the under surface of the corresponding clamping tongue, the cam surface of the tongue acts to move the end portion downwardly into tighter clamping engagement with the documents which underlie the clamping plate.

BRIEF DESCRIPTION OF THE DRAWINGS

A quick release document file embodying the invention will now be described, by way of example, with reference to the accompanying drawings in which.

DESCRIPTION OF THE PREFERRED EMBODIMENTS

The file to be described is a folder for holding punched documents such as letters and includes a quick release mechanism. The clamping mechanism can, however, be incorporated in a more robust file having a back fold interconnecting two covers, by attachment to a holding strip anchored in the file.

Figure 2:
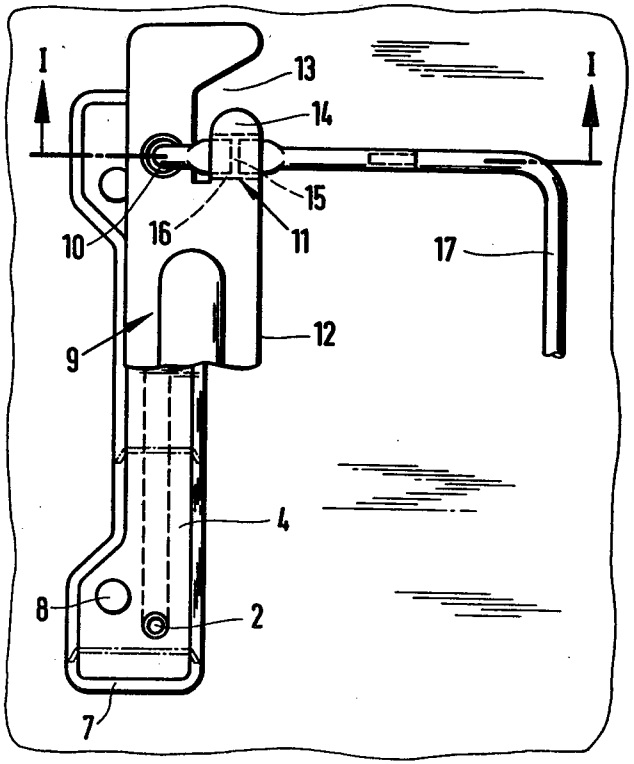
FIG. 2 is a fragmentary plane view of the file of FIG. 1 to an enlarged scale, and with the file open.
Figure 1:
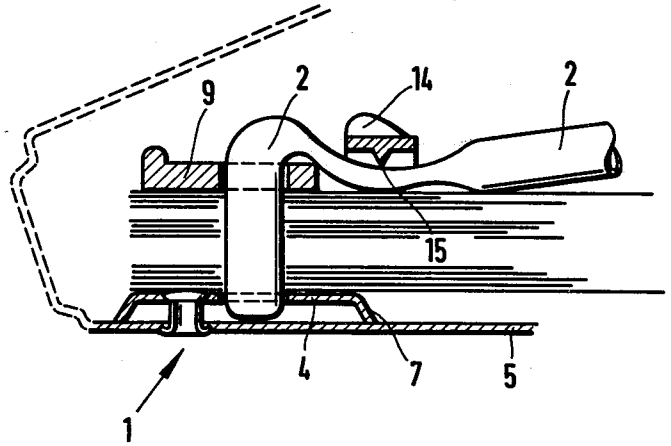
FIG. 1 is a fragmentary cross-section through the file along line I—I in FIG. 2.
Figure 3:
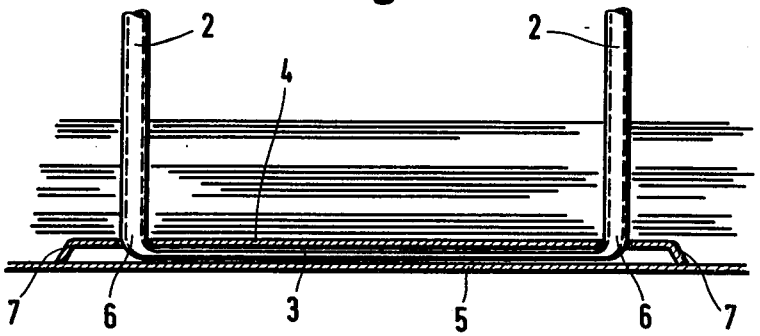
FIG. 3 is a fragmentary longitudinal section through the file of FIG. 1.

As shown in FIG. 1, the clamping mechanism includes a flexible thin-walled plastic tube having a central portion 3 clamped by a holding fillet 4 (such as made of synthetic plastic) to the bottom of the file 5 or, in the case of the more robust file, to a holding strip, not shown. The two end portions 2 of the tube pass through respective holes 6 in the holding fillet 4. The two holes 6 are spaced by a distance corresponding to the punched holes in the documents to be retained by the file. The two end portions 2 form tongues which are to be threaded through respective ones of the holes in the punched documents to be retained by the file. The holding fillet 4 is substantially U-shaped in cross-section, to accommodate the central portion of the tube. The legs 7 of the 'U' shaped holding fillet 4 are splayed slightly outwardly to ensure good all-round contact of the holding fillet 4 to the bottom of the file or to the holding strip when the fillet is anchored. The height of the legs 7 corresponds at least to double the wall thickness of the plastic tube. Opposite longitudinal end portions of the holding fillet are enlarged to provide sufficient area to accommodate a hollow rivet, by means of which the holding fillet 4 can be riveted to the bottom of the file 5 or holding strip.

The clamping mechanism also includes a clamping plate 9 for clamping documents located between the holding fillet 4 and the plate 9. The clamping plate, which can be made by injection moulding or injection pressing, has two holes 10 for receiving respective tongues 2 and two clamping flanges 11. The two flanges 11 extend longitudinally of the plate 9 from opposite longitudinal ends of a central portion of the plate defined by a pair of longitudinally spaced recesses 13 in one lateral side of the plate. Each clamping flange 11 has a free end portion 14 which is inclined upwardly (as viewed in FIG. 1) out of the plane of the plate 9 to enable a corresponding tongue 2 to be eased under the clamping flange 11 after being threaded through a corresponding hole 10 in the plate.

Each clamping flange 11 carries on its underside a rib 15 of triangular cross-section with the apex pointing toward the documents as shown in FIG. 1, and extending longitudinally of the plate 9 and arranged to engage a corresponding tongue 2 so as to increase the force with which the tongue is urged against the stack of filed documents (see FIG. 1) by virtue of the natural resilience of the clamping flange 11. Each clamping flange also includes on its underside two ridges extending transversely of the plate at opposite ends of the rib 15. These two ridges 16 act to resist movement of a tongue 2 longitudinally of the plate 9 when clamped by the rib 15. Preferably the ridges 16 have a greater height than the rib 15 so that when a tongue is moved transversely of itself under its corresponding clamping flange it will engage and be caused to roll over the first ridge 16 which it encounters, thus introducing a twist in itself to improve the manner in which it effects clamping.

The free ends of the tongues 2 can be interconnected by means of a back-laying strap 17, so that when the clamping action of the clamping plate is eased it is possible to turn over the pages in the file in a manner similar to that of the pages of a book.

The plastic thin-walled tube used in the described clamping mechanism is resilient and flexible and therefore always tends to revert, whenever it can, to its original shape in which it extends rectilinearly and has a circular cross-section. The central portion of the tube may be held in a flattened configuration by welding the facing inner surfaces of the tube together when in its flattened state.

I claim:

1. A quick release clamping mechanism for a document file, comprising:

a flexible and resilient hollow tube of plastic having a central portion and two end portions, means for anchoring said central portion of the tube to the file, and an elongate clamping plate defining two holes for receiving end portions of the tube and spaced longitudinally of the plate by a distance corresponding to that between holes punched in documents to be held by the file and a central portion located between the two holes, the clamping plate also having two clamping tongues extending longitudinally of the plate away from opposite longitudinal ends of the central portion of the plate, each tongue being aligned transversely of the plate with a corresponding one of said holes in the plate and defining, on the face thereof arranged to face the documents when held by the file, a cam surface on each tongue defining a tube trapping recess for trapping a corresponding end portion of the tube and adapted to improve the wedging effect on a corresponding end portion of the tube when wedged between the clamping tongue and the documents, said cam surface on each tongue comprising a rib of triangular cross section with the apex pointing toward the documents and extending longitudinally of the clamping plate, and two ridges located at opposite ends of said rib and extending transversely of said rib, each ridge being of greater height, in a direction extending perpendicularly of the plate, than its corresponding rib.

* * * * *